US007056433B2

(12) United States Patent
Swistun

(10) Patent No.: US 7,056,433 B2
(45) Date of Patent: Jun. 6, 2006

(54) GUTTER SCREEN TERMINATION TRIM WITH WATER TENSION BREAKER

(76) Inventor: Kazimierz Swistun, 1149 Parker La., Buffalo Grove, IL (US) 60089

( * ) Notice: Subject to any disclaimer, the term of this patent is extended or adjusted under 35 U.S.C. 154(b) by 31 days.

(21) Appl. No.: 10/760,561

(22) Filed: Jan. 20, 2004

(65) Prior Publication Data

US 2005/0155920 A1 Jul. 21, 2005

(51) Int. Cl.
*E04D 13/76* (2006.01)

(52) U.S. Cl. ..... 210/162; 210/163; 210/474; 15/12

(58) Field of Classification Search ..... 210/162, 210/163, 474; 52/11, 12, 16
See application file for complete search history.

(56) References Cited

U.S. PATENT DOCUMENTS

| | | | | | |
|---|---|---|---|---|---|
| 0,474,442 | A | | 5/1892 | Byers et al. | |
| 0,870,165 | A | | 11/1907 | Hagler et al. | |
| 2,365,845 | A | * | 12/1944 | Schweda | 52/12 |
| 2,423,923 | A | * | 7/1947 | Audino | 210/474 |
| 2,734,467 | A | * | 2/1956 | Steele | 52/12 |
| 3,351,206 | A | * | 11/1967 | Wennerstrom | 210/474 |
| 4,253,281 | A | | 3/1981 | Ruttenberg | |
| 4,404,775 | A | | 9/1983 | Demartini | |
| 4,644,704 | A | | 2/1987 | Pedgonay | |
| 4,745,710 | A | | 5/1988 | Davis | |
| 4,750,300 | A | * | 6/1988 | Winger, Jr. | 52/12 |
| 4,765,101 | A | | 8/1988 | Wolf | |
| 4,959,932 | A | | 10/1990 | Pfeifer | |
| 5,056,276 | A | | 10/1991 | Nielsen et al. | |
| 5,109,640 | A | | 5/1992 | Creson | |
| 5,257,482 | A | | 11/1993 | Sichel | |
| 5,321,920 | A | | 6/1994 | Sichel | |
| 5,406,754 | A | | 4/1995 | Cosby | |
| 5,566,513 | A | | 10/1996 | Herren | |
| 5,848,857 | A | * | 12/1998 | Killworth et al. | 52/11 |
| 6,164,020 | A | | 12/2000 | Nitch | |
| 6,427,388 | B1 | | 8/2002 | Brochu | |
| 6,598,352 | B1 | | 7/2003 | Higginbotham | |
| 2001/0009083 | A1 | | 7/2001 | Sullivan | |
| 2001/0037610 | A1 | | 11/2001 | Davis | |
| 2002/0100223 | A1 | | 8/2002 | Brochu | |
| 2002/0166290 | A1 | | 11/2002 | Bergeron | |
| 2003/0009951 | A1 | | 1/2003 | Bergeron | |
| 2003/0046876 | A1 | | 3/2003 | Higginbotham | |
| 2003/0070366 | A1 | | 4/2003 | Beyers | |
| 2003/0110712 | A1 | | 6/2003 | Brochu | |
| 2005/0028452 | A1 | * | 2/2005 | Brochu | 52/12 |

* cited by examiner

*Primary Examiner*—Christopher Upton
(74) *Attorney, Agent, or Firm*—Meroni & Meroni; Charles F. Meroni, Jr.; Christopher J. Scott

(57) ABSTRACT

The present invention provides a gutter screen attachment for minimizing water film runoff and debris collection adjacent a screened gutter. The screen attachment comprises a superior breaker edge, an inferior breaker edge, and a screen-receiving region. The screen-receiving region comprises an edge-receiving fold that accepts the gutter-engaging edge of a gutter screen. The superior breaker edge extends upwardly opposite the inferior breaker edge and is designed to break the water tension of a water film formed upon the gutter screen. The inferior breaker edge is designed to prevent water leakage between the screen attachment and the gutter. The superior breaker edge is of minimized height so as to allow bulky debris to translate over the superior breaker edge. It is thus contemplated that the superior breaker edge functions to allow water to more properly permeate through the gutter screen.

20 Claims, 5 Drawing Sheets

GUTTER SCREEN TERMINATION TRIM WITH WATER TENSION BREAKER

BACKGROUND OF THE INVENTION

1. Field of the Invention

The present invention generally relates to an improved gutter screen assembly for installation on gutters. More particularly, the present invention relates to an edging device for attachment to gutter screens to improve or enhance the effectiveness of gutter screens by minimizing water runoff and debris collection adjacent the outfitted gutter.

2. Description of the Prior Art

Water molecules comprise two atoms of hydrogen and one atom of oxygen; water is thus often referred to by its chemical composition: $H_2O$. The unique chemical composition of water contributes to a certain "sticky" property of water. When molecules stick together, they do so as a result of hydrogen bonding and when water is in its liquid form, its hydrogen bonds are very fragile. The hydrogen bonds form, break, and re-form with great frequency. Each hydrogen bond lasts only a few trillionths of a second, but the molecules bond promiscuously to a succession of neighbors, giving water fairly firm structure. Collectively, the hydrogen bonds hold the substance together, a phenomenon known as cohesion.

Cohesion due to hydrogen bonding contributes to the transport of water against gravity and it is this property that has led to the development of the present invention. Related to cohesion is surface tension, which is a measure of how difficult it is to stretch or break the surface of a liquid. At the interface between water and air is an ordered arrangement of water molecules, hydrogen bonded to one another and to the water below, making the water behave as though it were covered with an invisible film. Surface tension causes water on a surface to bead into a spherical shape having the smallest ratio of area to volume, maximizing the number of hydrogen bonds that can form.

Water has a great surface tension. If one could see molecules of water and how they act, one would notice that each water molecule electrically attracts its neighbors. Readily observable, however, is the tendency for water to form droplets rather than to spread out. Further, as is perhaps most famously appreciated by the water strider insect, the surface of a body of water is held together in a film. It is noted that if the molecules of a liquid did not attract one another, then the constant thermal agitation of the molecules would cause the liquid to instantly boil or evaporate.

Hydrogen atoms have single electrons which tend to spend a lot of their time "inside" the water molecule, toward the oxygen atom, leaving their outsides naked, or positively charged. The oxygen atom has eight electrons, and often a majority of them are around on the side away from the hydrogen atoms, making this face of the atom negatively charged. Since opposite charges attract, the hydrogen atoms of one water molecule like to point toward the oxygen atoms of other molecules. Of course, in the liquid state, the molecules have too much energy to become locked into a fixed pattern; nevertheless, the numerous temporary "hydrogen bonds" between molecules make water an extraordinarily sticky fluid.

Within the water, at least a few molecules are away from the surface and every molecule is engaged in a tug of war with its neighbors on every side. For every "up" pull there is a "down" pull, and for every "left" pull there is a "right" pull, and so on, so that any given molecule feels no net force at all. At the surface things are different. There is no up pull for every down pull, since of course there is no liquid above the surface; thus the surface molecules tend to be pulled back into the liquid and it requires work to pull a molecule up to the surface. If the surface is stretched—as when you blow up a bubble—it becomes larger in area, and more molecules are dragged from within the liquid to become part of this increased area. This "stretchy skin" effect is what is commonly referred to as surface tension. It will thus be seen that surface tension thus plays an important role in the way liquids behave.

When rain drops come into contact with a roof, the droplets do adhere to one another via the described atomic processes. Additionally, the droplets interact with the roof surface and with the gutter screen surface via similar atomic processes. If an observer were to inspect a gutter screen during a rain shower, the observer would no doubt see that the water-accepting apertures in the gutter screen often become filled with a film of water. On this macroscopic scale, it may be further observed that additional forces act upon the newly forming body(ies) of water. In this regard, it is observed that the gravitational forces, normal forces and frictional forces combine to create a net force causing the rainwater to flow in a direction toward gutter systems, which are primarily designed to catch, collect and divert water runoff to downspouts for directing roof water away from building structures to prevent water damage.

It is noted that the prior art gutter screen systems teach a number of gutter screen systems having varying levels of effectiveness. The gutter screen systems, as described and taught, for example, by U.S. Pat. No. 5,257,482 ('482 Patent) and U.S. Pat. No. 5,321,920 ('920 Patent) perform fairly well. However, it is noted that in order to catch a maximum of roof water runoff, the screen or mesh components of the '482 Patent and the '920 Patent have to be precisely curved or made concave to the external viewpoint during installation. In this last regard, it should be particularly noted that in order for such a curved gutter screen to properly perform, the same must be installed by well trained and experienced installers. The gutter protection systems as taught by the '920 Patent and '482 Patent are likely to fail (or perform poorly) if inexperienced persons install the same, such as may be the case when such systems are sold to the public as a cost effective do-it-yourself system. Given an improper installation, some of the roof water runoff runs over the edge of the gutter system, thus defeating the very purpose of the gutter system. Thus the curved screens as exemplified by the '920 Patent and the '482 Patent when properly installed, effectively allow roof water runoff to permeate the water-accepting grid or screen. However, it is the curved feature of these types of screens that tends to contribute to debris collection over time. Given sufficient time and debris collection, the water-accepting grid becomes clogged with debris, thereby decreasing the effectiveness of the gutter screen, and ultimately leading to probable water damage.

Since debris collection may lead to screen clogging and eventual damage to either the home or other building, home and building owners thus typically consider the described debris collection highly troublesome. Angled, planar gutter screens are generally considered preferable to curved gutter screens in terms of providing means for allowing debris to freely translate from the roof border region, over the gutter opening to a state of free fall adjacent the affixed gutter. It will thus be noted that by installing the gutter screen in a taught, straight or substantially planar configuration, as exemplified by U.S. Pat. No. 4,644,704 ('704 Patent)), one may be able to significantly reduces debris collection on the gutter screen.

However, when gutter screens or mesh installations are installed in a taught, straight, or substantially planar manner, roof water runoff has a tendency to flow over the edge of the gutter due to water surface tension and momentum. A common method or means of preventing water runoff from flowing over the edge of the gutter is to install a relatively tall edging (often referred to as "walls" or "guards" ) at the inferior most edge of the gutter screen (as taught by U.S. Pat. Nos. 4,765,101; 5,566,513; 6,427,388, respectively). It is noted that these so-called walls or guards effectively stop the roof water runoff. However, these walls or guard structures also have a tendency to collect debris behind them, which debris collection also leads to screen clogging, and eventual water damage, substantially as earlier described.

From a review of the above-referenced patents and other prior art generally known to exist, it will be seen that the prior art does not teach a structure, uniquely configured for breaking the water surface tension of water films formed upon gutter screen applications. Further, the prior art does not teach a structure is usable in connection with existing angled, planar gutter screen systems for improving or enhancing the effectiveness thereof by functioning to both break water surface tension of water films and allow bulky debris to translate over the water tension breaker. The prior art thus perceives a need for a water tension breaker usable in combination with a gutter screen to provide a means to break the surface tension of water and allow water-accepting grids or regions to accept greater quantities of water runoff, thereby reducing "over-the-edge" water runoff, and further to prevent or minimize debris collection upon the gutter screen.

SUMMARY OF THE INVENTION

Accordingly, it is an object of the present invention to provide a low cost, maintenance-efficient gutter screen assembly, which gutter screen assembly enables the user to simultaneously (1) break the water surface tension of roof water runoff upon gutter screens, mesh, grids, and the like, thus allowing water-accepting screens, mesh, grids or regions installed on gutters to accept greater quantities of roof water runoff, thereby reducing "over-the-edge" roof water runoff, (2) prevent or minimize debris collection upon the gutter screen, and (3) significantly reduce the overall gutter protection system cost by eliminating (a) the need for highly trained experienced installers and (b) the need for a specific customer service system guaranteeing expected results.

It is a further object of the present invention to provide a gutter screen termination trim for use in combination with a gutter screen, which gutter screen termination trim embodies improvements over the state of the art. Further, it is an object of the present invention to provide a gutter screen assembly constructed from low cost materials, formed into a readily reversible gutter screen attachment for installation on either heavy roof water runoff or typical roof water runoff applications.

To achieve these and other readily apparent objectives, the present invention provides a uniquely configured gutter screen attachment or gutter screen termination trim comprising a water tension breaker for use in combination with a conventional gutter and angled, planar gutter screen. The resulting gutter screen assembly is designed for minimizing roof water runoff and debris collection adjacent a conventional gutter. Such gutters essentially comprise a roof-engaging portion and a substantially horizontal gutter rim portion opposite the roof-engaging portion. The gutter rim portion essentially comprises an inner rim edge and an outer rim edge. The roof-engaging portion is typically affixed adjacent a roof border region of a building structure or home.

The gutter screen assembly essentially comprises, in combination, a gutter screen and a gutter screen termination trim comprising a water tension breaker. The gutter screen itself essentially comprises a plurality of edges, including a roof-engaging edge, a gutter-engaging edge, and two latitudinally-opposed screen edges. The gutter screen further essentially comprises a plurality of longitudinally-aligned ribs extending from the roof-engaging edge to the gutter-engaging edge, and a plurality of latitudinally-aligned ribs extending intermediate the latitudinally-opposed screen edges. The longitudinally-aligned ribs intersect with the latitudinally-aligned ribs and thus form a series of intersection points. The longitudinally-aligned ribs, the latitudinally-aligned ribs and the intersection points together define a substantially planar water-accepting grid.

The gutter screen termination trim with water tension breaker essentially comprises a substantially vertical superior breaker edge, a substantially vertical inferior breaker edge, and a substantially horizontal screen-receiving region intermediate the superior and inferior breaker edges. The superior and inferior breaker edges are substantially coplanar. The screen-receiving region essentially comprises an edge-receiving fold, which edge-receiving fold in turn essentially comprises a substantially U-shaped edge and two substantially parallel edge-engaging regions. The edge-receiving fold is designed to receive the gutter-engaging edge of the gutter screen, thus sandwiching the gutter-engaging edge intermediate the edge-engaging regions. The roof-engaging edge of the screen is affixed adjacent the roof border region of the subject building structure. The edge-receiving fold and gutter-engaging edge are affixed in superior adjacency to the gutter rim portion such that the inferior breaker edge extends downwardly snugly adjacent the inner rim edge and thus functions to position the gutter screen termination trim atop the gutter rim portion. The U-shaped edge is designed to be spatially located in superior adjacency to, or substantially flush with, the outer rim edge. The superior breaker edge thus extends upwardly opposite the inferior breaker edge and is designed to break the water tension of a water film formed upon the gutter screen. Further, the superior breaker edge is of minimized vertically-extending height so as to allow bulky debris to translate over the superior breaker edge and off the U-shaped edge of the gutter screen termination trim for free fall to the ground below. It is thus contemplated that the superior breaker edge functions to allow water to more properly permeate through the water-accepting grid into the gutter.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows:

FIG. 1(*a*) is an enlarged fragmentary view of the preferred gutter assembly as depicted in FIG. 1.

FIG. 2(*a*) is an enlarged fragmentary view of the preferred gutter assembly as depicted in FIG. 2.

DETAILED DESCRIPTION OF THE PREFERRED EMBODIMENT

After careful observation and experiment, it was discovered that what seems like typical "over-the-edge" roof water runoff, is often a very thin film of water. This thin film of water has a tendency to run over the water-accepting apertures of a variety of gutter screens due to its water tension. In other words the hydrogen bonds in thin films of water are sufficiently strong to overcome gravitational forces and thus function to cause water film overflow in many gutter screen systems, especially when the screen is installed in a planar configuration without being curved down. The solution was to develop a small raised edge along the path of the described thin water film water runoff or overflow. The raised edge must be tall enough to break the water tension, but short enough so it does not create a wall, behind which small debris may collect. The small raised edge may thus be referred to as a water tension breaker. By installing a properly configured gutter screen termination trim with water tension breaker on a gutter screen, water film formed upon the gutter screen may more readily be broken, thus allowing water to more readily permeate through the water-accepting grid or screen. Furthermore, given the minimized height of the water tension breaker, the water tension breaker also functions to minimize debris collection.

Figure 1:
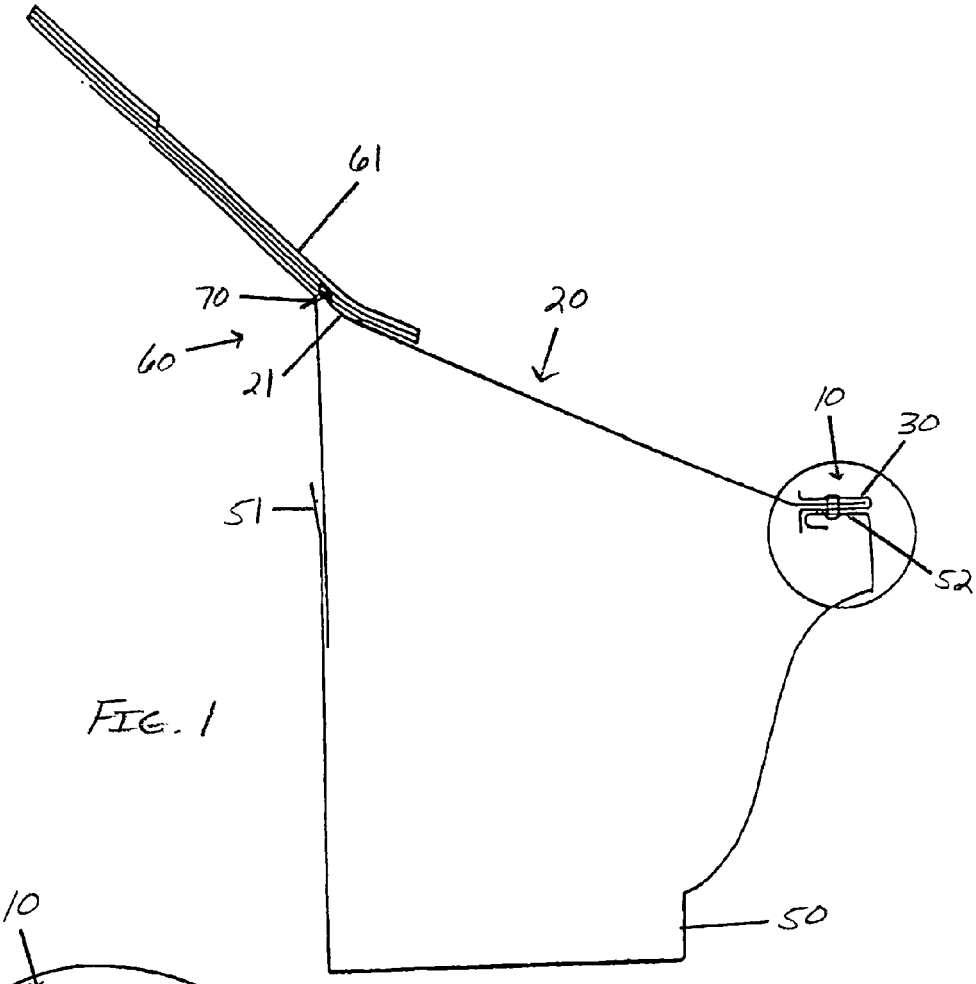
FIG. 1 is a fragmentary cross-sectional side view of a roof border region, a gutter, and the preferred gutter screen assembly.
Figure 1A:
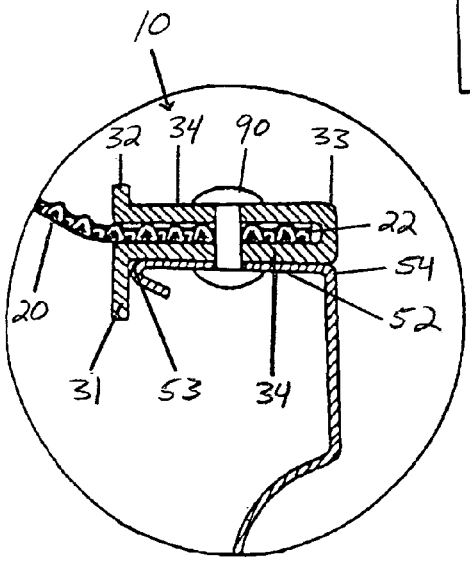

Referring now to the drawings, the preferred embodiment of the present invention is contemplated for use in roofing scenarios where roofing materials comprise asphalt shingles that allow insertion of gutter screens thereunder at the roof edge or termination. The preferred embodiment of the present invention thus concerns a gutter screen assembly 10 for use in combination with a conventional gutter 50 to minimize roof water runoff and debris collection. Gutter screen assembly 10 is generally referenced in FIGS. 1–3; gutter 50 is generally illustrated in FIGS. 1, 1(*a*), 3, and 4; and a typical roof border region 60 is illustrated in FIGS. 1, 2, and 3–9. The preferred embodiment of gutter screen assembly 10 for minimizing water runoff and debris collection is designed for use in combination with gutter 50. In this regard, it is contemplated that gutter 50 preferably comprises a roof-engaging portion 51 as illustrated in FIGS. 1, 3, and 4; and a substantially horizontal gutter rim portion 52 as illustrated in FIGS. 1, 1(*a*), and 3. Gutter rim portion 52 preferably comprises an inner rim edge 53 and an outer rim edge 54 as generally illustrated in FIGS. 1 and 3, and as specifically referenced in FIG. 1(*a*). It will thus be seen that roof-engaging portion 51 is designed for fixed placement adjacent roof border region 60. As has been illustrated in FIGS. 1 and 3, roof-engaging portion 51 is preferably affixed adjacent roof border region 60.

Figure 2:
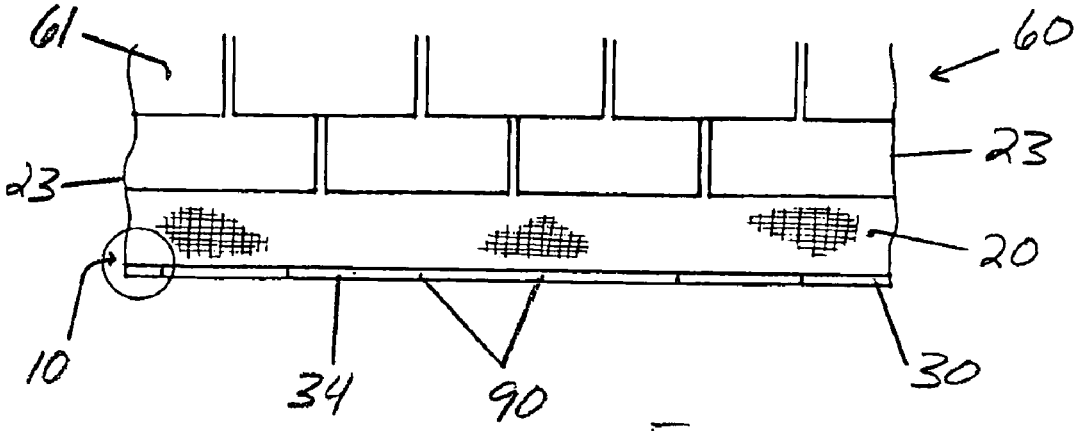
FIG. 2 is a fragmentary top plan view of a roof border region and the preferred gutter screen assembly.
Figure 2A:
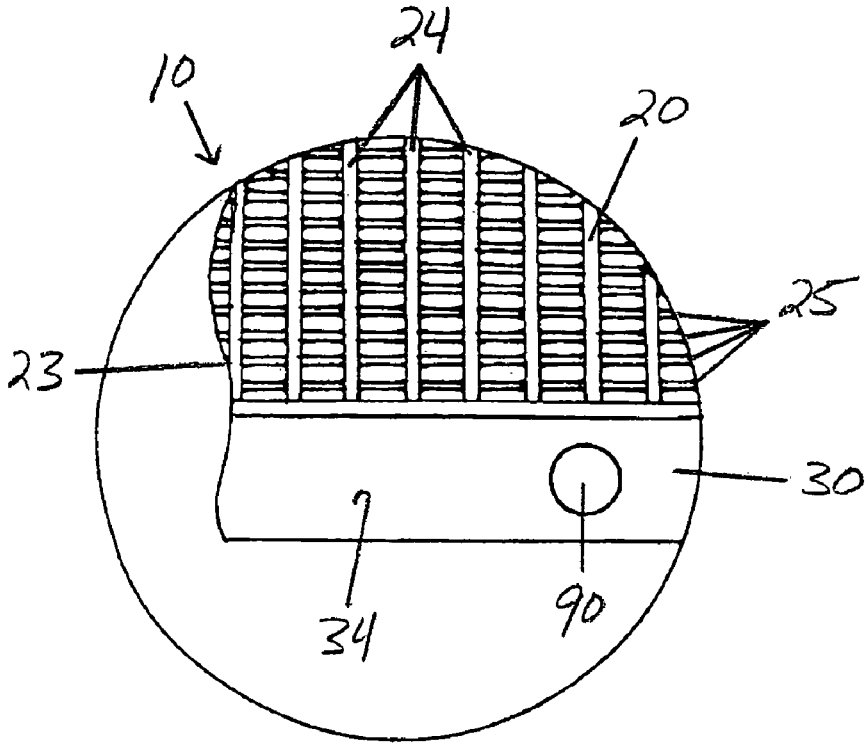
Figure 3:
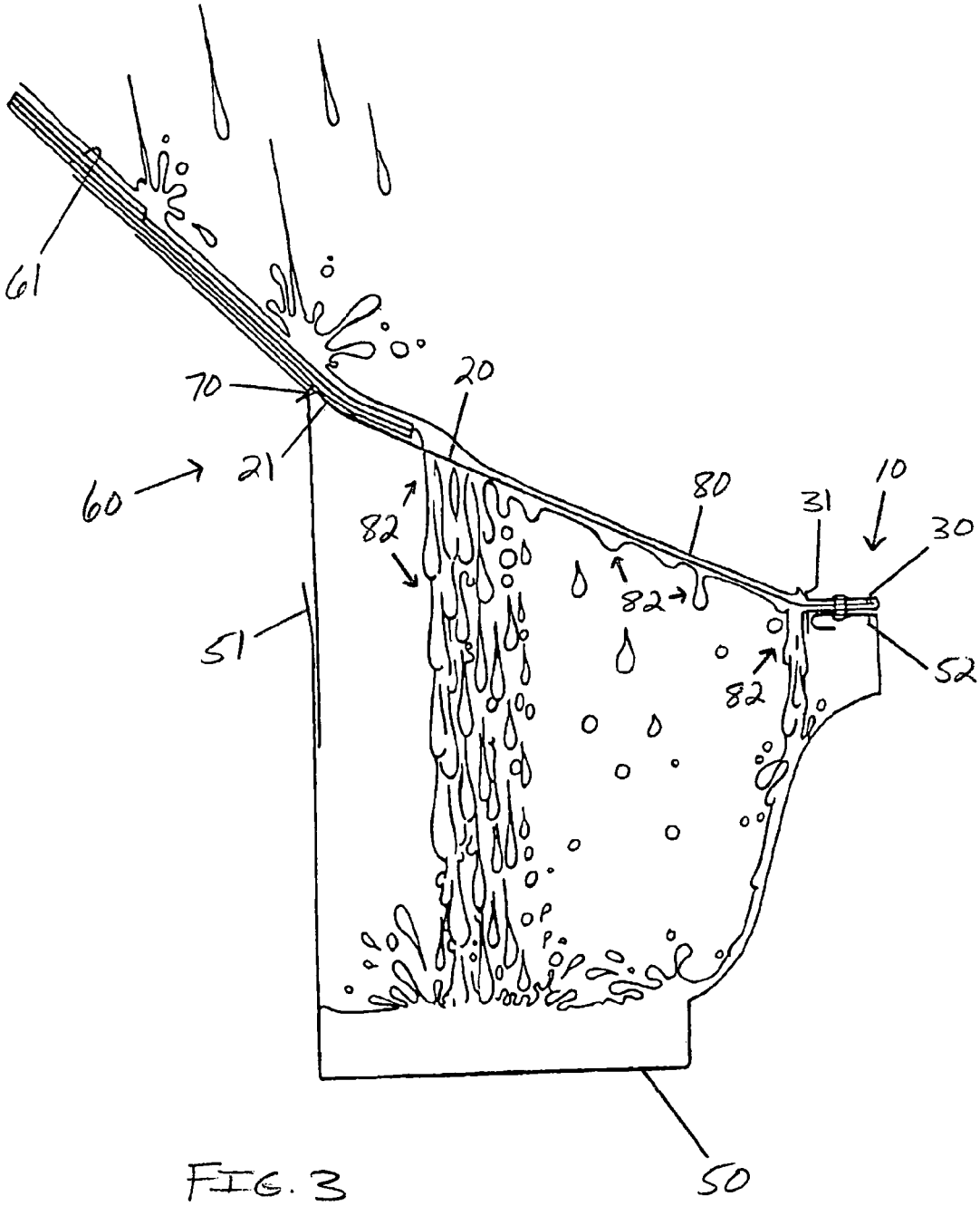
FIG. 3 is a fragmentary cross-sectional side view of a roof border region, a gutter, and the preferred gutter screen-assembly, showing roof water runoff and gutter collection thereof.
Figure 4:
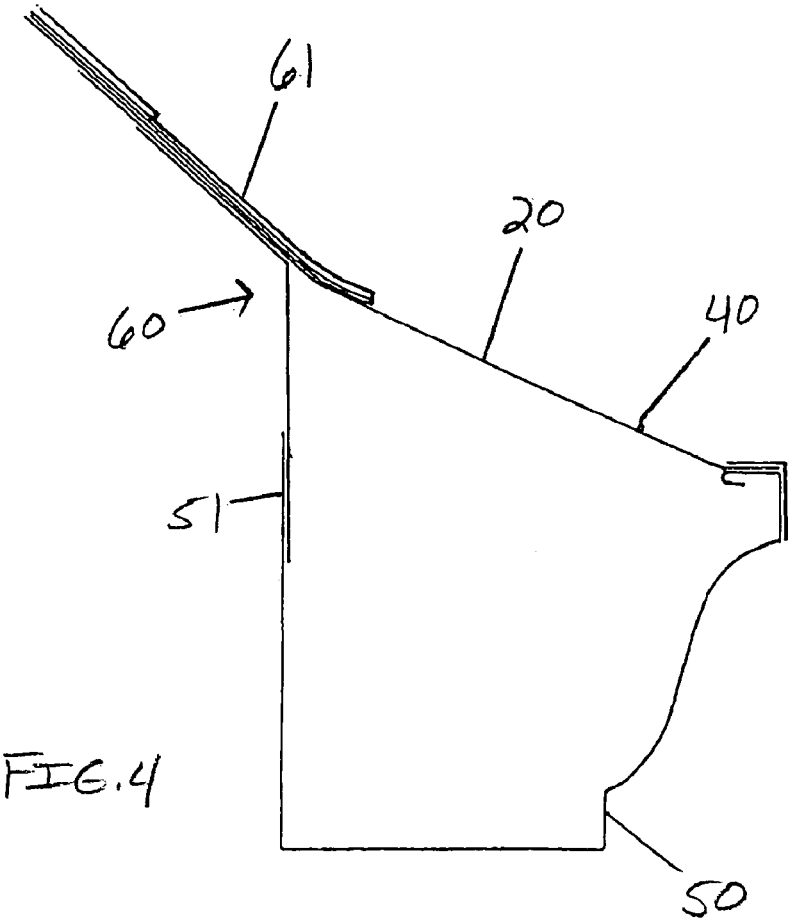
FIG. 4 is a fragmentary cross-sectional side view of a roof border region, a gutter, and a first alternative embodiment of the gutter screen assembly.

Gutter screen assembly 10 preferably comprises, in combination a gutter screen 20 as illustrated in FIGS. 1–9; and a gutter screen termination trim 30 as also illustrated in FIGS. 1–3. Gutter screen 20 is preferably constructed from Ultraviolet (UV) protective plastic (preferably black), the durability of which can be warranted for at least 10 years. Excellent results have been obtained when gutter screen 20 is constructed from a LEAFSCREENER brand screen, mesh, or water-accepting grid as manufactured and sold by The Leafscreener System USA, Inc., 1305 F. Street, Floresville, Tex., 78114.

Preferably, gutter screen 20 comprises a plurality of border edges and a substantially planar water-accepting region or water-accepting grid intermediate the border edges. The border edges preferably include a roof-engaging edge 21 as illustrated in FIGS. 1 and 3; a gutter-engaging edge 22 as illustrated in FIG. 1(*a*); and two latitudinally-opposed screen edges 23 as referenced and represented at the boundary regions of the fragmentary views of FIGS. 2 and 2(*a*). It will be further seen that gutter screen 20 preferably comprises a plurality of longitudinally-aligned ribs 24, which ribs 24 extend from roof-engaging edge 21 to gutter-engaging edge 22 as generally illustrated in FIG. 2(*a*). Still further, it will be seen that gutter screen 20 preferably comprises a plurality of latitudinally-aligned ribs 25, which ribs 25 extend intermediate latitudinally-opposed screen edges 23 as generally illustrated in FIG. 2(*a*). It will thus be understood from an inspection of FIG. 2(*a*) that longitudinally-aligned ribs 24 preferably intersect with latitudinally-aligned ribs 25 thus forming a series of intersection points. Together, longitudinally-aligned ribs 24, latitudinally-aligned ribs 25 and the intersection points define a substantially planar water-accepting grid as is generally depicted in FIGS. 2 and 2(*a*). From an inspection of FIGS. 1 and 3, the reader will appreciate that gutter screen 20 is a water-accepting grid or water-accepting region that is substantially planar in orientation. It will be recalled that planar screen configurations are preferable to curved screen orientations when minimization of debris collection is desired.

"It should be noted that longitudinally-aligned ribs 24 preferably have a substantially uniform latitudinal distance therebetween and that latitudinally-aligned ribs 25 have a substantially uniform longitudinal distance therebetween. In this regard, the preferred latitudinal distance ranges from a dimension greater than zero (0) to about 5 millimeters (mm) and the preferred longitudinal distance ranges from a dimension greater than zero (0) to about 1.75 mm. The resulting water-receiving apertures thus function to keep debris with structural dimensions larger than those here specified from entering the gutter. It will be recalled that LEAFSCREENER brand water-accepting grids or screens have proven to be highly effective for keeping debris from entering gutter systems. However, the water-receiving apertures so defined by longitudinally-aligned ribs 24 and latitudinally-aligned ribs 25 are so dimensioned so as to also enable gravity-defying water films to form. It will thus be noted that the longitudinally-aligned ribs preferably have a substantially uniform latitudinal distance thereberween and the latitudinally-aligned ribs preferably have a substantially uniform longitudinal distance therebetween, the latitudinal distance ranging from a dimension greater than 0 millimeters to about 5 millimeters and the longitudinal distance ranging from a dimension greater than 0 millimeters to about 1.75 millimeters. Together, the longitudinal and latitudinal distances function to enhance (water) film formability and debris filtering adjacent the gutter screen."

It should be noted that the present invention may be used in combination with a host of variably constructed water-accepting grids or screens comprising water-accepting apertures of various shapes and sizes. The above description is intended as a preferred specification of the ideal water-accepting grid and is not meant to any way limit the present invention. For example, it is contemplated that the present invention may be used in combination with water-accepting grid or screen having diagonally aligned ribs, thus forming parallelogram-shaped or diamond-shaped water accepting apertures. Screens of this type may also be successfully used in combination with the present invention. Excellent results have been obtained, however, utilizing a water-accepting grid substantially as earlier described.

To remedy water film runoff, gutter screen assembly 10 further comprises gutter screen termination trim 30 as earlier indicated. Gutter screen termination trim 30 is also preferably constructed from Ultraviolet (UV) protective plastic (preferably black), the durability of which can be warranted for at least 10 years. It should be noted that other materials such as 0.024 gauge aluminum (with a black finish) may be used in the construction of gutter screen termination trim 30. In this regard, it is noted that aluminum is more durable than plastic, and thus it will last longer than plastic. However, the final product will be more expensive when aluminum is used as opposed to when the described plastic is used. Further, the screen or mesh as provided by manufacturers such as The Leafscreener System USA, Inc. typically warrant the durability of the product for about 10 years. It is thus contemplated that a material providing durability to match that of the gutter screen 20 is to be preferred, so as to keep costs of installation and maintenance at a minimum.

Gutter screen termination trim 30 preferably comprises a substantially vertical first breaker edge, a substantially vertical second breaker edge, a select positioning breaker edge 31 as illustrated in FIG. 1(*a*), a select tension-breaking breaker edge 32 as illustrated in FIG. 1(*a*), and a substantially horizontal screen-receiving region intermediate the first and second breaker edges. The select breaker edges, namely, select positioning breaker edge 31 and select tension-breaking breaker edge 32, are preferably defined by being selected from the group consisting of the first and second breaker edges. In other words, it is contemplated that the termination trim or gutter screen termination trim 30 is preferably reversible, depending on the specific gutter/roof setup. The taller edge works much better at the areas with high water volume, such as roof valley exits to inside gutter corners. Gutter screen termination trim 30 is preferably made in 5 foot lengths for easy shipment, while gutter screen 20 may be shipped in continuous lengths or rolls per a given application.

The first and second breaker edges (i.e. select positioning breaker edge 31 and select tension-breaking breaker edge 32) are preferably substantially coplanar as may be seen from a general inspection of FIG. 1(*a*). The screen-receiving region preferably comprises a (screen) edge-receiving fold, which preferably comprises a substantially U-shaped edge 33 and two substantially parallel edge-engaging regions 34 as illustrated in FIG. 1(*a*), 2 and 2(*a*). The edge-receiving fold is thus designed to receive gutter-engaging edge 22 such that the edge-receiving fold effectively sandwiches gutter-engaging edge 22 intermediate edge-engaging regions 34. Gutter screen termination trim 30 is preferably fastened to gutter rim portion 52 with fasteners 90 as illustrated in FIG. 1 (*a*). Fasteners 90 may comprise rivets or screws.

Roof-engaging edge 21 is designed for fixed attachment adjacent roof border region 60. FIGS. 1 and 3 generally depict the typical structural arrangement in which roof-engaging edge 21 is affixed adjacent roof border region 60. In this regard, it should be noted that roof-engaging edge 21 is typically attached or affixed to roof border region 60 with a fastener 70 such that roof-engaging edge 21 lies in inferior adjacency to the termination shingles 61 of roof border region 60 as generally illustrated in FIGS. 1 and 3. Termination shingles 61 are further illustrated in FIGS. 2 and 4–9. Oftentimes, it is not recommended that roof-engaging edge 21 be placed under the roofing materials in the described fashion, such as when slate tiles are used for roofing material. It is for this reason that roof-engaging edge 21 has been described as being designed for fixed attachment adjacent roof border region 60.

The edge-receiving fold and gutter-engaging edge 22 are thus designed for fixed attachment in superior adjacency to gutter rim portion 52 as generally depicted in FIGS. 1, 1(*a*), and 3 and as may generally be gleaned from an inspection of FIGS. 2 and 2(*a*). Gutter screen termination trim 30 may be attached to gutter rim portion 52 with screws or rivets 90 as illustrated in FIGS. 1(*a*), 2, and 2(*a*). The edge-receiving fold and gutter-engaging region 22 are thus affixed in superior adjacency to gutter rim portion 52 such that select positioning breaker edge 31 extends downwardly snugly adjacent inner rim edge 53 as most clearly illustrated in FIG. 1(*a*). It will be seen that select positioning breaker edge 31 thus serves a positioning function by enabling the installer of gutter screen termination trim 30 to more properly position gutter screen termination trim 30 upon installation. Additionally, it should be noted that the substantially vertical inferior breaker edge has an additional role of protecting against water leakage between the gutter and trim. Preferably, edge-engaging regions 34 are of sufficient dimension such that U-shaped edge 33 is spatially located in superior adjacency to, or substantially flush with, outer rim edge 54 after installation as may be generally seen from an inspection of FIG. 1(*a*).

It will be further seen that select tension-breaking breaker edge 32 preferably extends upwardly opposite select positioning breaker edge 31. It will be recalled that select tension breaking breaker edge 32 and select positioning breaker edge 31 are preferably coplanar. Select tension-breaking breaker edge 31 thus lies in a breaker plane with select positioning breaker edge 32, which breaker plane is preferably substantially parallel with the eaves of roof border region 60. In other words, it is preferred that the breaker plane is substantially vertical as are earlier specified. Select tension-breaking breaker edge 31 is thus designed for breaking the water surface tension of a water film 80 formed upon gutter screen 20 thus allowing water 81 to permeate (as depicted at 82) through the water-accepting grid into gutter 50 all as generally illustrated and referenced in FIG. 3.

The first breaker edge and the second breaker edge each have a preferred, critical measurable vertical dimension. After researching and developing the present invention, it has come to light that the preferred measurable vertical dimensions (of the first breaker edge and the second breaker edge) each may be selected from an edge dimension range, the edge dimension range ranging from about 2 mm to about 6 mm. The positioning and water breaking functions of the select positioning breaker edge and the select tension-breaking breaker edge, respectively, are realized when either of the breaker edges are dimensioned between about 2 mm and about 6 mm. However, the ideal vertical dimensions may be assigned to the breaker edges 31 and 32 when the measurable vertical dimensions are selected from a select dimension grouping, the select dimension grouping consisting of the dimensions 3 mm and 6 mm. In other words, the preferred dimensions of select positioning breaker edge 31 and select tension-breaking breaker edge 32 are selected from either 3 mm or 6 mm. It will be recalled in this regard that gutter screen termination trim 30 is reversible or upendable.

In other words, the first breaker edge may be either the superior tension-breaking breaker edge or the inferior positioning breaker edge per the installer election. In corresponding fashion, the second breaker edge may be either the superior tension-breaking breaker edge or the inferior positioning breaker edge per the installer election. While the upper edge takes the role of water tension breaker, the bottom edge prevents water leakage between gutter screen termination trim 30 and gutter rim portion 52 as earlier noted. That is, the first breaker edge may comprise either select positioning breaker edge 31 or select tension-breaking breaker edge 32 and the second breaker edge may correspondingly comprise either select tension-breaking breaker edge 32 or either select positioning breaker edge 31. In the typical application scenario, the first breaker edge is defined by select tension-breaking breaker edge 32, which edge ideally measures about 3 mm from the horizontal superior edge-engaging region 34 and the second breaker edge is defined by select positioning breaker edge 31, which edge measures about 6 mm from the horizontal inferior edge-engaging 34. In sum, the ideal height of select tension-breaking breaker edge 32 is 3 mm. After considerable amount of experiment and research, it has been discovered that given a gutter screen application, the water surface tension of a water film formed upon the gutter screen may be most successfully overcome when the water film flows against tension-breaking breaker edge having a vertical height dimension of about 3 mm. Favorable results, however, have been obtained when the select tension-breaking breaker edge comprises a vertical chosen from a range of about 2 mm to about 6 mm. A select tension-breaking breaker edge higher than 6 mm will have a tendency to start collecting debris behind it and a select tension-breaking breaker edge lower than 2 mm is insufficiently tall to break the water surface tension of a water film formed upon the gutter screen or water-accepting grid or region.

The ideal solution to significantly improve the performance of screen systems such as those taught by the '482 Patent and the '920 Patent is a specifically designed screen termination trim or gutter screen termination trim 30 such as been described, which gutter screen termination trim comprises two raised edges, with the ideal 3 mm raised edge on one side and the maximum 6 mm raised edge on the other side. That termination trim is reversible and in most application scenarios, installation of gutter screen termination trim 30 is such that the 3 mm edge goes up. In high water volume areas, however, the other 6 mm edge performs better. The typical example of high water volume area is an inside gutter corner, where water collected from large roof areas drains into a fairly narrow inside gutter corner. The screen/mesh may thus be inserted into the termination trim or gutter screen termination trim 30 substantially as described hereinabove and installed such that select tension-breaking breaker edge 32 measures about 6 mm in height and is in a superior water tension-breaking position.

Alternative Embodiments

An alternative embodiment of the present invention also concerns a gutter screen assembly for minimizing water runoff and debris collection adjacent gutter 50. The alternative embodiment of the gutter screen assembly, however, is designed such that water tension breaking edge is positioned on the screen itself instead of being integrally formed with gutter screen termination trim 30. The alternative embodiment of the present invention thus comprises, in combination gutter screen 20 (substantially as earlier described) and at least one, but possibly many, latitudinally-aligned water tension breaker(s) or raised tension-breaking member(s) 40 as comparatively illustrated in FIGS. 4–9. In this regard, it will be seen from a comparison of FIG. 4 with FIGS. 5–9 that FIG. 4 illustrates a single raised tension-breaking member and FIGS. 5–9 each illustrate a plurality of raised tension-breaking members 40 in various configurations.

Figure 5:
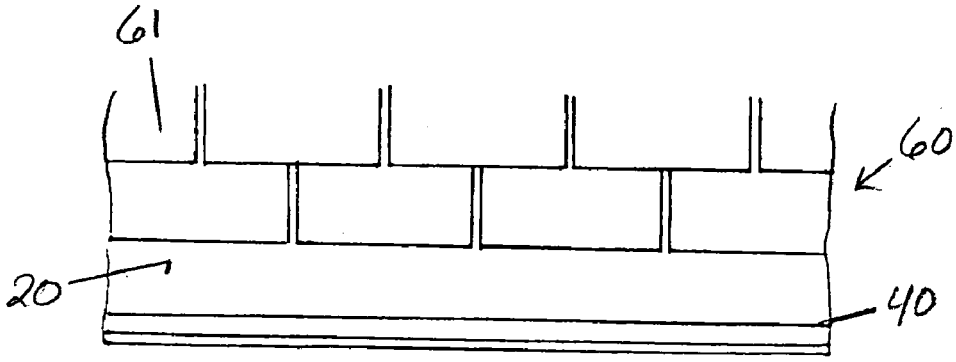
FIG. 5 is a fragmentary top plan view of a roof border region and a first alternative embodiment of the gutter screen assembly.
Figure 6:
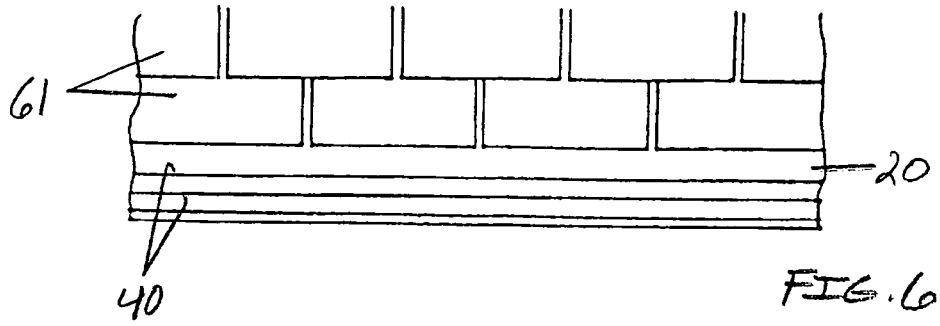
FIG. 6 is a fragmentary top plan view of a roof border region and a second alternative embodiment of the gutter screen assembly.
Figure 7:
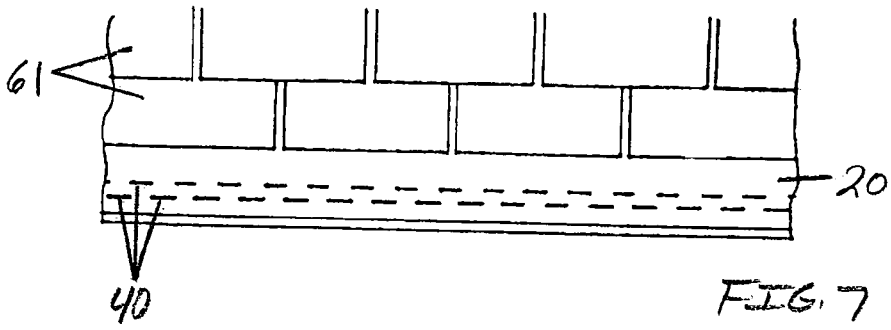
FIG. 7 is a fragmentary top plan view of a roof border region and a third alternative embodiment of the gutter screen assembly.
Figure 8:
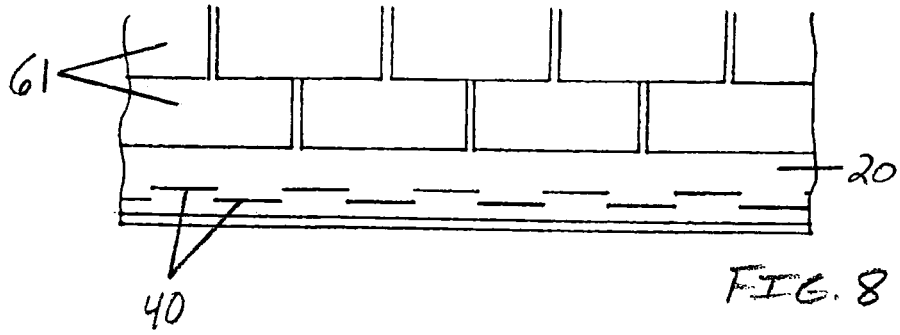
FIG. 8 is a fragmentary top plan view of a roof border region and a fourth alternative embodiment of the gutter screen assembly.
Figure 9:
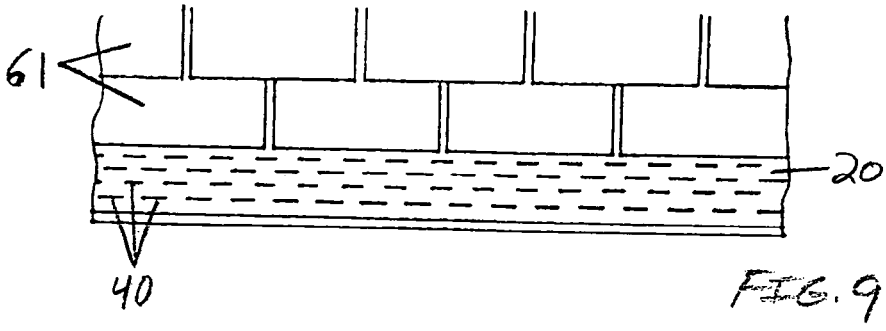
FIG. 9 is a fragmentary top plan view of a roof border region and a fifth alternative embodiment of the gutter screen assembly.

Each raised tension-breaking member 40 is preferably oriented intermediate the latitudinally-opposed screen edges and is cooperatively associated with the water-accepting grid or water-accepting region for breaking the water surface tension of a water film formed upon gutter screen 20 thus allowing water to permeate through the water-accepting grid into gutter 50. It will thus be seen that an alternative solution to water film runoff is to cooperatively associate the water tension-breaking edge with gutter screen 20 itself. The raised edge can be continuous across the length intermediate the latitudinally-opposed screen edges as generally depicted in the fragmentary views of FIGS. 5 and 6, or staggered across the length intermediate the latitudinally-opposed screen edges as generally depicted in the fragmentary views of FIGS. 7–9. In any event, each raised tension-breaking member 40 can be integrally formed as a part of gutter screen 20 (in which case gutter screen 20 would be altered to comprise raised latitudinal rib portions) or can be formed as a narrow trim for attachment to gutter screen 20. Further, as illustrated in FIGS. 4 and 5, a single raised tension-breaking member 40 may be set in the pathway of the running water, or, as illustrated in FIG. 6, a plurality of rows (two as shown) of raised tension-breaking members 40 may be set in the path of running water.

It is further contemplated that in the alternative embodiments, at least one raised tension-breaking member 40 may lie in a breaker plane, the breaker plane being either substantially orthogonal to the water-accepting grid or region or substantially vertical. In either case, it is contemplated that at least one raised tension-breaking member 40 has a measurable vertical dimension, the measurable vertical dimension being selected from a breaker dimension range, the breaker dimension range ranging from about 2 mm to about 6 mm, but preferably about 3 mm, substantially as earlier described.

It is noted that the angle of inclination of planar gutter screens is not uniform from building to building. However, it is further noted that the angle of inclination rarely exceeds 25 rotational degrees from the horizontal. If the breaker plane is orthogonal to the plane of the water-accepting grid, it is contemplated that the raised height of the tension-breaking members 40 from the plane of the water-accepting grid may be described as follows:

For an angle of inclination of about 5 degrees from the horizontal, it is contemplated that the preferable raised height of the tension-breaking member be about 3.01 mm. For an angle of inclination of about 10 degrees from the horizontal, it is contemplated that the preferably raised height of the tension-breaking member be about 3.05 mm. For an angle of inclination of about 15 degrees from the horizontal, it is contemplated that the preferably raised height of the tension-breaking member be about 3.11 mm. For an angle of inclination of about 20 degrees from the horizontal, it is contemplated that the preferable raised height of the tension-breaking member be about 3.19 mm. For an angle of inclination of about 25 degrees from the horizontal, it is contemplated that the preferable raised height of the tension-breaking member 40 be about 3.31 mm. It will thus be seen that the preferred raised perpendicular height of the tension-breaking member from the water-accepting grid may be calculated according to the formula:

$$h=[(3\text{ mm})/\text{cosine }(\theta)]$$

Where:

(1) the tension-breaking member height=(h);

(breaker plane orthogonal to water-accepting grid)

(2) the ideal vertical height=(3 mm); and (3) the angle of inclination off horizontal for the water-accepting grid=(θ).

It will be seen that the present invention provides a low cost, maintenance-efficient gutter screen assembly, which gutter screen assembly enables the user to simultaneously (1) break the water surface tension of water film runoff, thus allowing water-accepting grids or regions installed on gutters to accept greater quantities of water, thereby reducing "over-the-edge" water runoff, and (2) prevent or minimize debris collection upon the gutter screen. In this regard, it will be seen that the present invention provides a gutter screen termination trim for use in combination with a gutter screen, which gutter screen termination trim embodies improvements over the state of the art. In this last regard, it will be seen that the present invention provides a uniquely configured structure for decreasing or eliminating water film runoff, which water film runoff is notably problematic in state of the art gutter screens. Further, it will be seen that the present invention provides a gutter screen assembly constructed or formed into a readily reversible gutter screen attachment for installation in either heavy water film runoff or typical water film runoff application scenarios.

More particularly, it will be seen that the present invention provides a uniquely configured gutter screen attachment or gutter screen termination trim with water tension breaker for use in combination with a conventional gutter and angled, planar gutter screen. The resulting gutter screen assembly provides a means for minimizing water runoff and debris collection adjacent a conventional gutter. It will be seen that the gutter screen assembly preferably comprises, in combination a gutter screen and a gutter screen termination trim. The gutter screen itself essentially provides a water-accepting grid or region comprising a plurality of edges, including a roof-engaging edge, a gutter-engaging edge, and two latitudinally-opposed screen edges. The gutter screen further essentially comprises a plurality of longitudinally-aligned ribs extending from the roof-engaging edge to the gutter-engaging edge, and a plurality of latitudinally-aligned ribs extending intermediate the latitudinally-opposed screen edges. The longitudinally-aligned ribs intersect with the latitudinally-aligned ribs and thus form a series of intersection points. The longitudinally-aligned ribs, the latitudinally-aligned ribs and the intersection points together define a substantially planar water-accepting grid.

It should be reiterated that the present described alternative embodiments of the present invention may be used in combination with a host of variably constructed water-accepting grids or screens comprising water-accepting apertures of various shapes and sizes. The above description is intended as a preferred specification of the ideal water-accepting grid and is not meant to any way limit the present invention. For example, it is contemplated that the present invention may be used in combination with water-accepting grid or screen having diagonally aligned ribs, thus forming parallelogram-shaped or diamond-shaped water accepting apertures. Screens of this type may also be successfully used in combination with the present invention. Excellent results have been obtained, however, utilizing a water-accepting grid substantially as earlier described.

The water tension breaker thus provides a means for breaking water tension of a water film formed upon the water-accepting grid and thus essentially comprises a substantially vertical superior breaker edge substantially as described herein, which substantially vertical superior breaker edge or water tension breaker is cooperatively associated with a gutter screen. It is thus contemplated that the superior breaker edge functions to allow water to more properly permeate through the water-accepting grid into the gutter.

"It will thus be understood that the present invention inherently teaches a gutter system for minimizing water runoff and debris collection adjacent an outfitted roof border region, which system comprises a gutter, a gutter screen, and a gutter screen termination trim. The gutter comprises a roof-engaging portion and a substantially horizontal gutter rim portion. The gutter rim portion comprises an inner rim edge and an outer rim edge. The roof-engaging portion is affixed adjacent the roof border region, the outfitting the roof border region.

The gutter screen comprises a roof-engaging edge, a gutter-engaging edge, two latitudinally-opposed screen edges, a plurality of longitudinally-aligned ribs extending from the roof-engaging edge to the gutter-engaging edge, and a plurality of latitudinally-aligned ribs extending intermediate the latitudinally-opposed screen edges. The longitudinally-aligned ribs intersect the latitudinally-aligned ribs to form a series of intersection points all of which define a substantially planar water-accepting grid.

The gutter screen termination trim comprises a vertically planar first breaker edge, a vertically planar second breaker edge, a select positioning breaker edge, a select tension-breaking breaker edge, and a horizontally planar screen-receiving region intermediate the first and second breaker edges. The select breaker edges are each selected from the group consisting of the first and second breaker edges. In other words, the trim is upendable or reversible. In any event, however, the first and second breaker edges are coplanar. The screen-receiving region comprises an edge-receiving fold comprising a substantially U-shaped edge and two substantially parallel edge-engaging regions. The edge-receiving fold receives the gutter-engaging edge and thus sandwiches the gutter-engaging edge intermediate the edge-engaging regions.

The roof-engaging edge is also affixed adjacent the roof border region and the edge-receiving fold and gutter-engaging edge are affixed in superior adjacency to the gutter rim portion. The select positioning breaker edge extends downwardly snugly adjacent the inner rim edge and thus, the U-shaped edge is spatially located in superior adjacency to the outer rim edge. The select tension-breaking breaker edge extends upwardly opposite the select positioning breaker edge for breaking the water surface tension of a water film formed upon the gutter screen thus allowing water to permeate through the water-accepting grid into the gutter.

Understood from an alternative perspective, the present invention discloses a gutter screen termination trim usable in combination with a gutter assembly of the type previously specified for miminizing water runoff and debris collection adjacent an outfitted roof border region. In this regard, it will be noted that the gutter screen termination trim is usable in combination with the gutter rim portion. The gutter rim portion comprises an inner rim edge and an outer rim edge, which outer rim edge inherently comprises an (outer) edge plane. The select positioning breaker edge is designed for positioned placement in snug adjacency to the inner rim edge and the U-shaped edge is designed for fixed placement in superior adjacency to the outer rim edge, the edge plane being substantially tangent to the U-shaped edge."

While the above description contains much specificity, this specificity should not be construed as limitations on the scope of the invention, but rather as an exemplification of the invention. For example, as is described hereinabove, it is contemplated that the edge-receiving fold and gutter-engaging edge 22 are designed for fixed attachment in superior adjacency to gutter rim portion 52. It will be recalled that the edge-receiving fold and gutter-engaging region 22 are preferably affixed in superior adjacency to gutter rim portion 52 such that select positioning breaker edge 31 extends downwardly snugly adjacent inner rim edge 53 as most clearly illustrated in FIG. 1(*a*). It will be further recalled that select positioning breaker edge 31 is intended, in part, to serve a positioning function by enabling the installer of gutter screen termination trim 30 to more properly position gutter screen termination trim 30 upon installation. In this regard, it is further contemplated that select positioning breaker edge may terminate in the breaker plane with no vertical dimension and still successfully fulfill a positioning function. In other words, it is contemplated that the select positioning breaker edge may be defined by the inferior terminus of the edge-engaging region, which terminus would necessarily lie either in or adjacent the breaker plane. The select positioning breaker edge could thus be used to properly position the gutter screen termination trim. While it is noted that constructing the gutter screen termination trim in this manner necessarily eliminates the reversible nature of the gutter screen termination trim, it is believed that the spirit of the present invention is still practiced.

Further, it is noted that various types of grid or screen systems are available to users. In this regard, it is contemplated that the gutter screen termination trim need not be installed on, or used in connection with, a gutter screen comprising longitudinally-aligned and latitudinally-aligned ribs as described herein. Rather, it is contemplated that the gutter screen termination trim may be used in connection with gutter screens, upon which water films tend to form. Accordingly, although the invention has been described by reference to a preferred embodiment, it is not intended that the novel assembly be limited thereby, but that modifications thereof are intended to be included as falling within the broad scope and spirit of the foregoing disclosure, the following claims and the appended drawings.

I claim:

1. A gutter screen assembly for minimizing water runoff and debris collection adjacent a gutter, the gutter comprising a roof-engaging portion and a substantially horizontal gutter rim portion, the gutter rim portion comprising an inner rim edge and an outer rim edge, the roof-engaging portion being affixed adjacent a roof border region, the gutter screen assembly comprising, in combination:

a gutter screen, the gutter screen comprising a roof-engaging edge, a gutter-engaging edge, two latitudinally-opposed screen edges, a plurality of longitudinally-aligned ribs extending from the roof-engaging edge to the gutter-engaging edge, and a plurality of latitudinally-aligned ribs extending intermediate the latitudinally-opposed screen edges, the longitudinally-aligned ribs intersecting with the latitudinally-aligned ribs thus forming a series of intersection points, the longitudinally-aligned ribs, the latitudinally-aligned ribs and the intersection points defining a substantially planar water-accepting grid; and a gutter screen termination trim, the gutter screen termination trim comprising a substantially planar vertical first breaker edge, a substantially planar vertical second breaker edge, a select positioning breaker edge, a select tension-breaking breaker edge, and a substantially horizontal screen-receiving region intermediate the first and second breaker edges, the select breaker edges each being selected from the group consisting of the first and second breaker edges, the first and second breaker edges being substantially coplanar, the screen-receiving region comprising an edge-receiving fold, the edge-receiving fold comprising a substantially U-shaped edge and two substantially parallel edge-engaging regions, the edge-receiving fold receiving the gutter-engaging edge, the edge-receiving fold thus sandwiching the gutter-engaging edge intermediate the edge-engaging regions, the roof-engaging edge being affixed adjacent the roof border region, the edge-receiving fold and gutter-engaging edge being affixed in superior adjacency to the gutter rim portion, the select positioning breaker edge extending downwardly snugly adjacent the inner rim edge, the U-shaped edge being spatially located in superior adjacency to the outer rim edge, the select tension-breaking breaker edge extending upwardly opposite the select positioning breaker edge, the select tension-breaking breaker edge for breaking the water surface tension of a water film formed upon the gutter screen thus allowing water to permeate through the water-accepting grid into the gutter.

2. The gutter screen assembly of claim 1 wherein the longitudinally-aligned ribs have a substantially uniform latitudinal distance therebetween and the latitudinally-aligned ribs have a substantially uniform longitudinal distance therebetween, the latitudinal distance ranging from a dimension greater than 0 millimeters to about 5 millimeters, the longitudinal distance ranging from a dimension greater than 0 millimeters to about 1.75 millimeters.

3. The gutter screen assembly of claim 1 wherein the first breaker edge and the second breaker edge each have a measurable vertical dimension, the measurable vertical dimensions each being selected from an edge dimension range, the edge dimension range ranging from about 2 millimeters to about 6 millimeters.

4. The gutter screen assembly of claim 3 wherein the measurable vertical dimensions are selected from a select dimension grouping, the select dimension grouping consisting of the dimensions of about 3 millimeters and about 6 millimeters.

5. The gutter screen assembly of claim 4 wherein the measurable vertical dimension of the first breaker edge measures about 3 millimeters and the measurable vertical dimension of the second breaker edge measures about 6 millimeters.

6. A gutter screen termination trim for use in combination with a gutter screen, the gutter screen termination trim for minimizing water runoff and debris collection adjacent a gutter, the gutter comprising a roof-engaging portion and a gutter rim portion, the roof-engaging portion for fixed attachment adjacent a roof border region, the gutter screen comprising a plurality of border edges and a substantially planar water-accepting region intermediate the border edges, the border edges comprising a roof-engaging edge, a horizontally planar gutter-engaging edge, and two latitudinally-opposed screen edges, the gutter screen termination trim comprising:

a substantially planar vertical first breaker edge, a substantially planar vertical second breaker edge, a select positioning breaker edge, a select tension-breaking breaker edge, and a screen-receiving region intermediate the first and second breaker edges, the select breaker edges being selected from the group consisting of the first and second breaker edges, the first and second breaker edges being substantially coplanar, the screen-receiving region comprising an edge-receiving fold, the edge-receiving fold comprising a substantially U-shaped edge and two substantially parallel edge-engaging regions, the edge-receiving fold for receiving the gutter-engaging edge, the edge-receiving fold for sandwiching the gutter-engaging edge intermediate the edge-engaging regions, the roof-engaging edge for fixed attachment adjacent the roof border region, the edge-receiving fold and gutter-engaging edge for fixed placement in superior adjacency to the gutter rim portion, the select tension-breaking breaker edge extending upwardly opposite the select positioning breaker edge, the select tension-breaking breaker edge for breaking the water surface tension of a water film formed upon the gutter screen thus allowing water to permeate through the water-accepting region into the gutter.

7. The gutter screen termination trim of claim 6 wherein the gutter screen termination trim is for use in combination with the gutter rim portion, the gutter rim portion comprising an inner rim edge and an outer rim edge, the select positioning breaker edge for positioned placement in snug adjacency to the inner rim edge, the U-shaped edge for fixed placement in superior adjacency to the outer rim edge.

8. The gutter screen termination trim of claim 6 wherein the first breaker edge and the second breaker edge each have a measurable vertical dimension, the measurable vertical dimensions each being selected from an edge dimension range, the edge dimension range ranging from about 2 millimeters to about 6 millimeters.

9. The gutter screen termination trim of claim 8 wherein the measurable vertical dimensions are each selected from a select dimension grouping, the select dimension grouping consisting of the dimensions of about 3 millimeters and about 6 millimeters.

10. The gutter screen termination trim of claim 9 wherein the measurable vertical dimension of the first breaker edge measures 3 millimeters and the measurable vertical dimension of the second breaker edge measures about 6 millimeters.

11. A gutter system for minimizing water runoff and debris collection adjacent an outfitted roof border region, the gutter system comprising, in combination:

a gutter, the gutter comprising a roof-engaging portion and a substantially horizontal gutter rim portion, the gutter rim portion comprising an inner rim edge and an outer rim edge, the roof-engaging portion being affixed adjacent the outfitted roof border region;

a gutter screen, the gutter screen comprising a roof-engaging edge, a gutter-engaging edge, two latitudinally-opposed screen edges, a plurality of longitudinally-aligned ribs extending from the roof-engaging edge to the gutter-engaging edge, and a plurality of latitudinally-aligned ribs extending intermediate the latitudinally-opposed screen edges, the longitudinally-aligned ribs intersecting with the latitudinally-aligned ribs thus forming a series of intersection points, the longitudinally-aligned ribs, the latitudinally-aligned ribs and the intersection points defining a substantially planar water-accepting grid; and a gutter screen termination trim, the gutter screen termination trim comprising a vertically planar first breaker edge, a vertically planar second breaker edge, a select positioning breaker edge, a select tension-breaking breaker edge, and a horizontally planar screen-receiving region intermediate the first and second breaker edges, the select breaker edges each being selected from the group consisting of the first and second breaker edges, the first and second breaker edges being coplanar, the screen-receiving region comprising an edge-receiving fold, the edge-receiving fold comprising a substantially U-shaped edge and two substantially parallel edge-engaging regions, the edge-receiving fold receiving the gutter-engaging edge, the edge-receiving fold thus sandwiching the gutter-engaging edge intermediate the edge-engaging regions, the roof-engaging edge being affixed adjacent the roof border region, the edge-receiving fold and gutter-engaging edge being affixed in superior adjacency to the gutter rim portion, the select positioning breaker edge extending downwardly snugly adjacent the inner rim edge, the U-shaped edge being spatially located in superior adjacency to the outer rim edge, the select tension-breaking breaker edge extending upwardly opposite the select positioning breaker edge, the select tension-breaking breaker edge for breaking the water surface tension of a water film formed upon the gutter screen thus allowing water to permeate through the water-accepting grid into the gutter.

12. The gutter system of claim 11 wherein the longitudinally-aligned ribs have a substantially uniform latitudinal distance therebetween and the latitudinally-aligned ribs have a substantially uniform longitudinal distance therebetween, the latitudinal distance ranging from a dimension greater than 0 millimeters to about 5 millimeters, the longitudinal distance ranging from a dimension greater than 0 millimeters to about 1.75 millimeters, the longitudinal and latitudinal distances for enhancing film formability and debris filtering adjacent the gutter screen.

13. The gutter system of claim 11 wherein the first breaker edge and the second breaker edge each have a measurable vertical dimension, the measurable vertical dimensions each being selected from an edge dimension range, the edge dimension range ranging from about 2 millimeters to about 6 millimeters.

14. The gutter system of claim 13 wherein the measurable vertical dimensions are selected from a select dimension grouping, the select dimension grouping consisting of the dimensions of about 3 millimeters and about 6 millimeters.

15. The gutter system of claim 14 wherein the measurable vertical dimension of the first breaker edge measures about 3 millimeters and the measurable vertical dimension of the second breaker edge measures about 6 millimeters.

16. A gutter screen termination trim for use in combination with a gutter assembly, the gutter screen termination trim for minimizing water runoff and debris collection adjacent an outfitted roof border region, the gutter assembly comprising a gutter and a gutter screen, the gutter comprising a roof-engaging portion and a gutter rim portion, the roof-engaging portion for fixed attachment adjacent the outfitted roof border region, the gutter screen comprising a plurality of border edges and a substantially planar water-accepting region intermediate the border edges, the border edges comprising a roof-engaging edge, a horizontally planar gutter-engaging edge, and two latitudinally-opposed screen edges, the gutter screen termination trim comprising a substantially vertically planar first breaker edge, a substantially vertically planar second breaker edge, a select positioning breaker edge, a select tension-breaking breaker edge, and a screen-receiving region intermediate the first and second breaker edges, the select breaker edges being selected from the group consisting of the first and second breaker edges, the first and second breaker edges being coplanar, the screen-receiving region comprising an edge-receiving fold, the edge-receiving fold comprising a substantially U-shaped edge and two substantially parallel edge-engaging regions, the edge-receiving fold for receiving the gutter-engaging edge, the edge-receiving fold for sandwiching the gutter-engaging edge intermediate the edge-engaging regions, the roof-engaging edge for fixed attachment adjacent the roof border region, the edge-receiving fold and gutter-engaging edge for fixed placement in superior adjacency to the gutter rim portion, the select tension-breaking breaker edge extending upwardly opposite the select positioning breaker edge, the select tension-breaking breaker edge for breaking the water surface tension of a water film formed upon the gutter screen thus allowing water to permeate through the water-accepting region into the gutter.

17. The gutter screen termination trim of claim 16 wherein the gutter screen termination trim is for use in combination with the gutter rim portion, the gutter rim portion comprising an inner rim edge and an outer rim edge, the outer rim edge comprising an edge plane, the select positioning breaker edge for positioned placement in snug adjacency to the inner rim edge, the U-shaped edge for fixed placement in superior adjacency to the outer rim edge, the edge plane being tangent to the U-shaped edge.

18. The gutter screen termination trim of claim 16 wherein the first breaker edge and the second breaker edge each have a measurable vertical dimension, the measurable vertical dimensions each being selected from an edge dimension range, the edge dimension range ranging from about 2 millimeters to about 6 millimeters.

19. The gutter screen termination trim of claim 18 wherein the measurable vertical dimensions are each selected from a select dimension grouping, the select dimension grouping consisting of the dimensions of about 3 millimeters and about 6 millimeters.

20. The gutter screen termination trim of claim 19 wherein the measurable vertical dimension of the first breaker edge measures 3 millimeters and the measurable vertical dimension of the second breaker edge measures about 6 millimeters.

* * * * *